US006402130B1

(12) United States Patent
Price et al.

(10) Patent No.: US 6,402,130 B1
(45) Date of Patent: Jun. 11, 2002

(54) CLAMP FOR A POWER TOOL

(75) Inventors: Scott D. Price, Singapore (SG); William R. Stumpf, Kingsville; Scott M. Livingston, Catonsville, both of MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/659,935

(22) Filed: Feb. 28, 2001

Related U.S. Application Data

(63) Continuation of application No. 09/239,991, filed on Oct. 30, 1998, now Pat. No. 6,139,000, which is a continuation of application No. 09/073,256, filed on May 5, 1998, now Pat. No. 5,913,509, which is a continuation of application No. 08/783,146, filed on Jan. 14, 1997, now Pat. No. 6,024,350.

(51) Int. Cl.[7] ..... B25B 5/00

(52) U.S. Cl. ..... 269/91; 269/254 CS; 269/71; 269/72

(58) Field of Search ..... 269/71, 246, 72, 269/74, 91, 93, 245, 254 CS

(56) References Cited

U.S. PATENT DOCUMENTS 2,671,482 A * 3/1954 Gordon ..... 269/249
3,599,960 A * 8/1971 Phillips ..... 269/246
5,913,509 A * 6/1999 Price et al. ..... 269/71
6,024,350 A * 2/2000 Price et al. ..... 269/71
6,139,000 A * 10/2000 Price et al. ..... 269/71

* cited by examiner

*Primary Examiner*—Joseph J. Hail, III
*Assistant Examiner*—Lee Wilson
(74) *Attorney, Agent, or Firm*—Adan Ayala

(57) ABSTRACT

In accordance with the present invention, an improved clamping apparatus is employed. The clamping apparatus includes a clamp body having a first and a second end, an attachment member having a first and second end, the first end of the attachment member connected to the first end of the clamp body, a clamping member having a first end and a second end, the clamping member slidably connected to the second end of the clamp body, a locking mechanism for locking the clamping member, and a spring biasing the locking mechanism towards a locking position. Preferably, the clamping member includes a pad disposed at the second end of the clamping member. Further, the clamping member may include a knob disposed at the first end of the clamping member. The clamping member may be a threaded rod. In addition, the locking mechanism may include a locking button that engages the threaded rod. This locking button has an upper surface. This upper surface may abut the clamp body upon rotation of the threaded rod.

1 Claim, 3 Drawing Sheets

CLAMP FOR A POWER TOOL

This is a continuation application under 37 CFR §1.53 (b), of prior application Ser. No. 09/239,991, filed on Oct. 30, 1998, now U.S. Pat. No. 6,139,000 entitled Clamp for a Power Tool which is a continuation of prior application Ser. No. 09/073,256, filed on May 5, 1998 now U.S. Pat. No. 5,913,509, which is a continuation of prior application Ser. No. 08/783,146, filed on Jan. 14, 1997 now U.S. Pat. No. 6,024,350.

FIELD OF THE INVENTION

This invention relates generally to clamps for power tools and, more particularly, to a clamp that is easy to install on the power tool and to adjust against a workpiece.

BACKGROUND OF THE INVENTION

When cutting a workpiece on a power tool, such as a miter saw, chop saw, drill press, table saw, etc., it may be desirable to clamp the workpiece to the base of the power tool or against a fence attached to the power tool. However, many individuals do not use available prior art clamps as they can be difficult to adjust when clamping or releasing a workpiece and/or difficult to install on the power tool. For example, some prior art clamps, such as the one illustrated in U.S. Pat. No. 5,582,089, requires a user to repeatedly rotate a threaded rod to clamp or release the workpiece.

It is therefore an object of this invention to provide a clamp that is easy to adjust when clamping or releasing a workpiece and that is easy to install on the power tool.

SUMMARY OF THE INVENTION

In accordance with the present invention, an improved clamping apparatus is employed. The clamping apparatus includes a clamp body having a first and a second end, an attachment member having a first and second end, the first end of the attachment member connected to the first end of the clamp body, a clamping member having a first end and a second end, the clamping member slidably connected to the second end of the clamp body, a locking mechanism for locking the clamping member, and a spring biasing the locking mechanism towards a locking position.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which.

DETAILED DESCRIPTION

Figure 1:
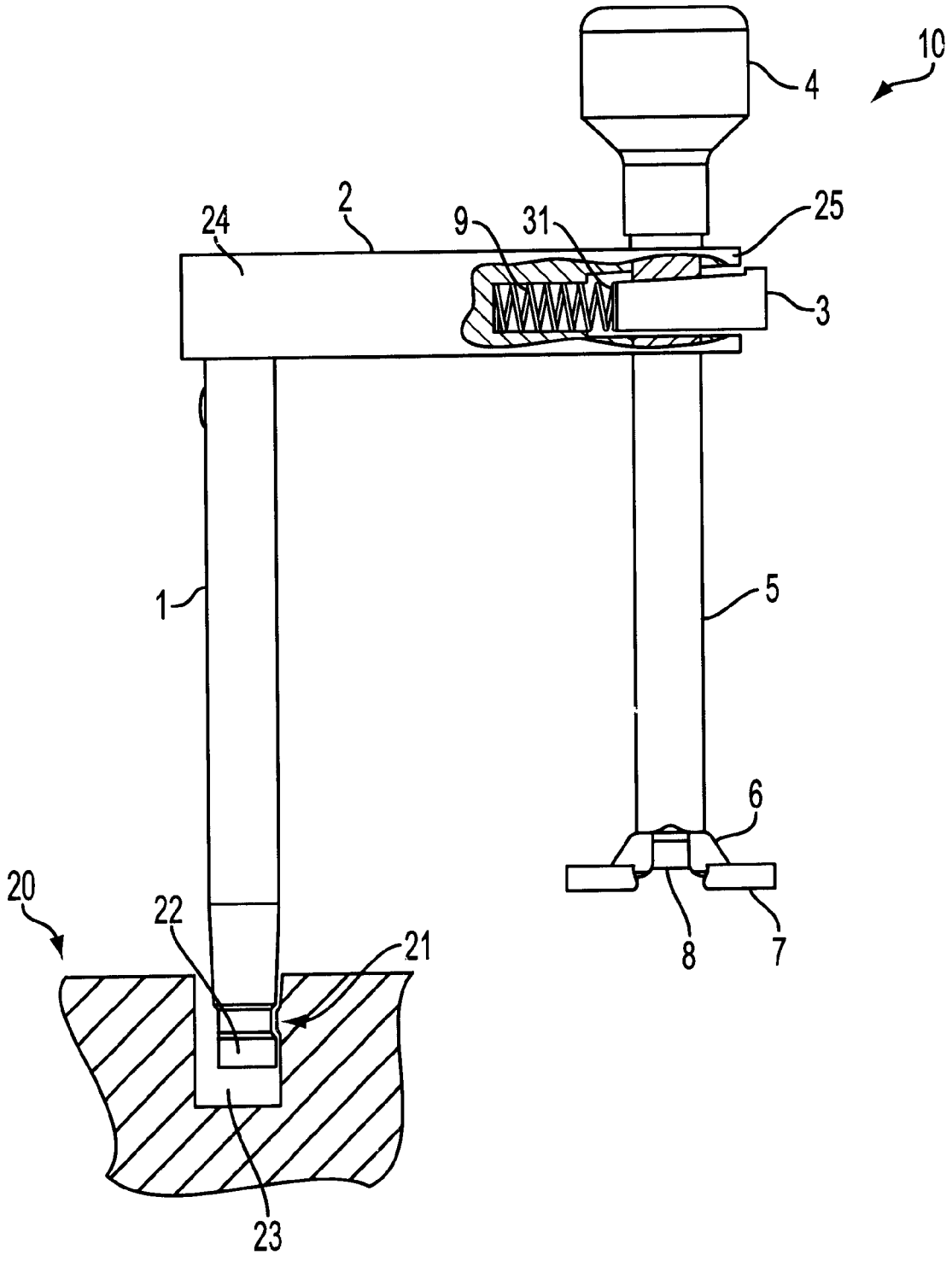
FIG. 1 is a partial cross-sectional side view of a clamping apparatus according to a first embodiment of the present invention.

The invention is now described with reference to the accompanying figures, wherein like numerals designate like parts. Referring to FIG. 1, a clamping apparatus 10 of the present invention is connected to a power tool, such as a sliding compound miter saw, a drill press, a table saw, etc.

Preferably, the clamping apparatus 10 includes an attachment rod 1 for attaching the clamping apparatus 10 to the table portion 20 of the power tool, a clamp body 2, a clamping rod 5 inserted through the clamp body 2, a moveable button 3 for locking and unlocking the clamping rod 5, and a spring 9 for normally biasing the button 3 to a locking position.

The attachment rod 1 is preferably cylindrical. The attachment rod 1 is fixedly attached at the first end 24 of the clamp body 2. Preferably, the attachment rod 1 has a decreasing diameter at the lower end, which expands into knob 22. Knob 22 has an upper projecting lip which extends partially around the upper circumference. The attachment rod 1 fits within hole 23 and is secured therein by rotating the upper projection lip so as to engage beneath flat 21.

The clamp body 2 can be one of a variety of shapes and is shown in the drawings as one specific configuration for illustration purposes only. Preferably, the clamp body 2 has a bore at its second end 25 that allows the clamping rod 5 to slide therethrough.

The clamping rod 5 is preferably opposite and generally parallel to the attachment rod 1. The clamping rod 5 may preferably include a pad 7 at its lower end adapted to contact a workpiece (not shown). The pad 7 may be made of a soft material, such as neoprene or rubber, so that it will not indent the workpiece when clamped.

Preferably the pad 7 is attached to a cup 6, which is turn attached to the clamping rod 5 via a joint 8. This joint 8 can be a ball and socket joint or a universal joint. Preferably, the joint 8 will consist of the cup 6 engaging the clamping rod 5 in such manner that the cup will be pivotally mounted to the clamping rod 5. In this manner the pad 7 may accommodate a workpiece which does not have a completely horizontal surface.

In addition, the clamping rod 5 preferably includes a knob 4 attached at its upper end to enable a user to push down on the clamping rod 5.

Figure 2:
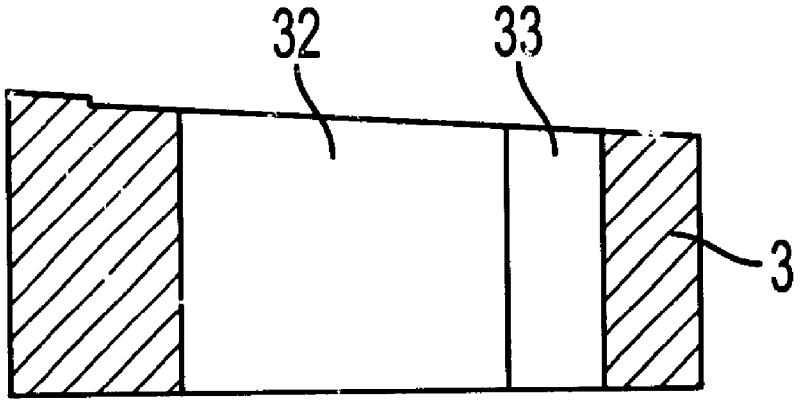
FIG. 2 is a cross-sectional side view of the button of the first embodiment.

The clamping rod 5 is preferably locked in place by a button 3. Referring to FIGS. 1 and 2, the button 3 is disposed in a cavity 31 within the clamp body 2. The button 3 has a bore 32 that allows the clamping rod 5 to slide therethrough. The button 3 has an inner surface 33 which abuts the clamping rod 5, locking it in place.

Preferably, a material with a high coefficient of friction, such as soft rubber, is disposed on the inner surface 33 to stop any movement of the clamping rod 5. However, a person skilled in the art will recognize other means for achieving the same purpose. For example, several protuberances, preferably made of a hard material, may be disposed on the inner surface of the button which would interact with cavities disposed on the clamping rod, and vice versa.

To assist in the locking operation, a spring 9 is disposed in a cavity 31 within the clamp body 2. Preferably, the spring 9 is disposed in such manner that it biases the button 3 into a locking position. Accordingly, in order to clamp a workpiece, a user would place the workpiece on the table 20, press the button 3, lower the clamping rod 5, and release the button 3. The spring 9 would then bring the button 3 into locking contact with the clamping rod 5.

Figure 4:
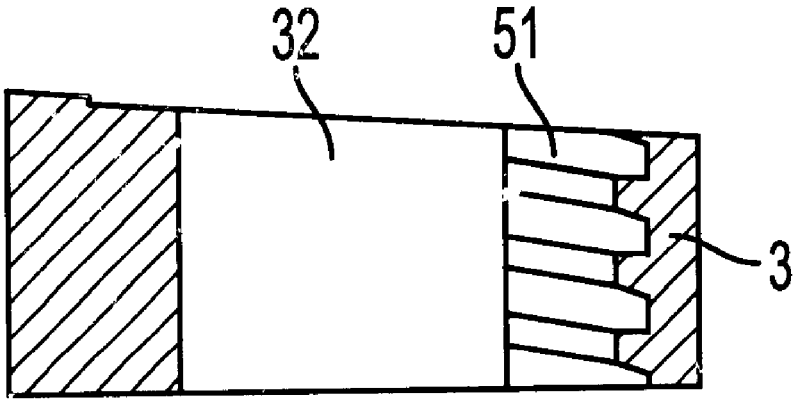
FIG. 4 is a cross-sectional side view of the button of the second embodiment.
Figure 3:
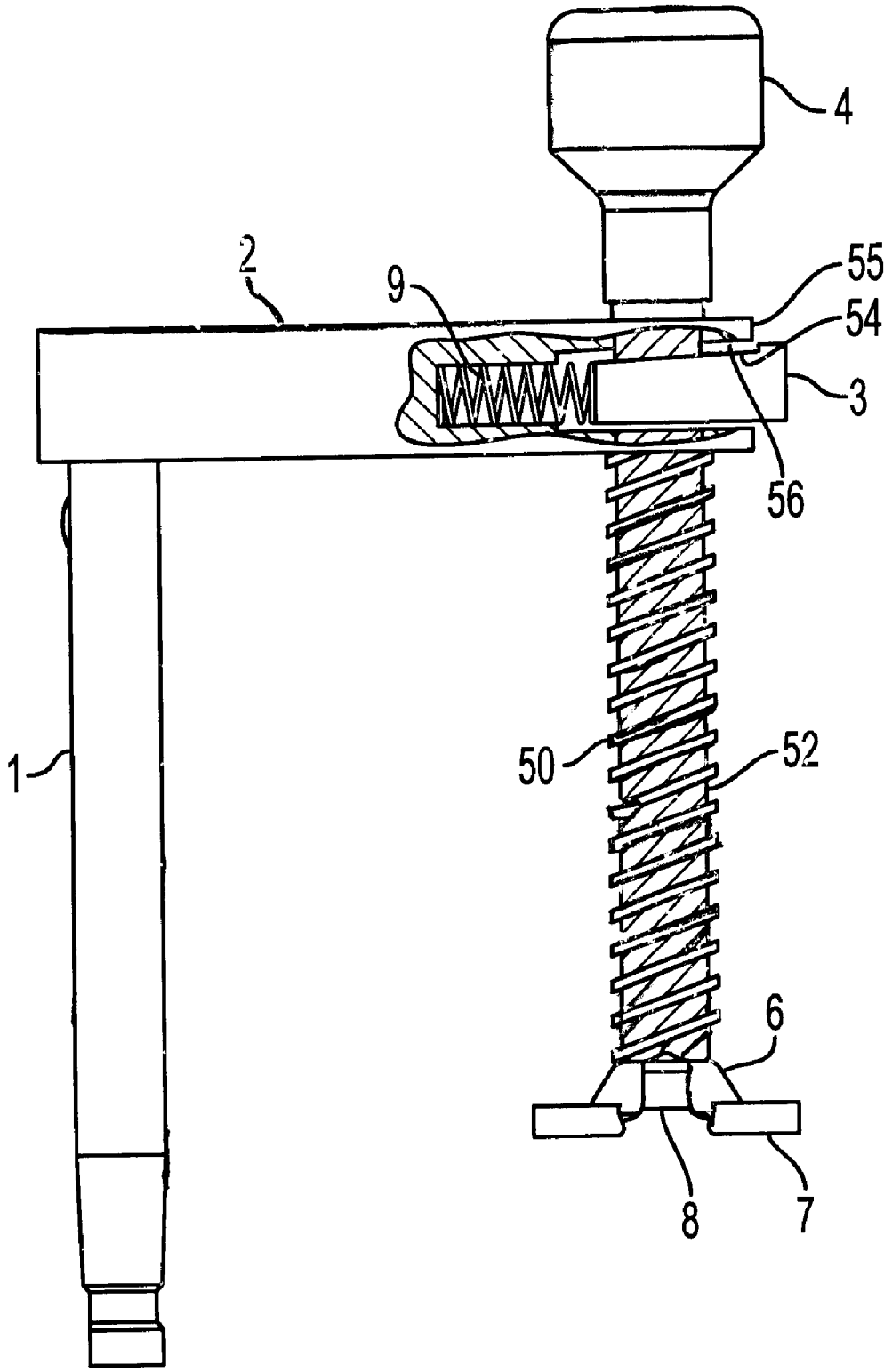
FIG. 3 is a partial cross-sectional side view of a clamping apparatus according to a second embodiment of the present invention.

A second embodiment is illustrated on FIGS. 3 and 4. In this embodiment, the clamping rod 52 is threaded.

Preferably, the thread of the clamping rod 52 has a low pitch, such as the ACME thread per ANSI B1.5-1977, Class 20, or the Powerscrew thread. Accordingly, more travel along the axis of the rod can be obtained with a smaller amount of rod rotation.

As shown in FIG. 4, the button 3 is also adapted to engage the threaded clamping rod 52. The button 3 has a thread receiving portion 51 that engages the threads 50 of the clamping rod 52. The thread receiving portion 51 is preferably made with a hard material.

This arrangement is especially advantageous for easy adjusting of the clamping apparatus. A user can clamp a workpiece by placing the workpiece on the table 20, pressing the button 3, lower the clamping rod 52, and release the button 3. The spring 9 then brings the button 3 into locking contact with the clamping rod 52.

A user can then tighten the clamping apparatus by rotating the clamping rod 52 using the knob 4. The clamping rod 52 travels downward due to the engagement between the thread receiving portion 51 of the button 3 and the threads 50 of the clamping rod 52. Similarly, the button 3 travels upward due to the engagement between the thread receiving portion 51 and the threads 50. This upward movement continues until the upper surface 54 of the button 3 contacts a surface 55 of the clamp body 2, closing gap 56 in between the button 3 and the upper surface 55 securely locking the clamping rod 52 in place. The number of rotations required to lock the clamping rod 52 as described above is significantly reduced because of the preferred low pitch thread.

Persons skilled in the art may recognize other alternatives to the means disclosed herein, such as placing the button and/or spring outside the clamp body, or disposing the button in such manner that it must be pulled out in order to unlock the clamping rod. However, all these additions and/or alterations are considered to be equivalents of the present invention.

What is claimed is:

1. A method for clamping a workpiece on a power tool using a clamping apparatus comprising a clamp body having a first and a second end, an attachment member having a first and second end, said first end of said attachment member connected to said first end of said clamp body, a clamping member having a first end and a second end, said clamping member slidably connected to the second end of the clamp body, a button mechanism disposed on said clamp body for locking the clamping member, the locking button comprising an upper surface, and a spring biasing the button mechanism towards a locking position, the method comprising the steps of:

placing the workpiece under the clamping member;

pressing the button mechanism;

lowering the clamping member until the clamping member contacts the workpiece;

releasing the button mechanism, simultaneously locking the clamping member; and rotating the clamping member until the upper surface of the locking button abuts the clamping body.

* * * * *